US010540926B2

(12) United States Patent
Wu et al.

(10) Patent No.: US 10,540,926 B2
(45) Date of Patent: Jan. 21, 2020

(54) PIXEL CIRCUIT, DRIVING METHOD THEREOF, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Hao Wu, Beijing (CN); Hongjun Yu, Beijing (CN); Na An, Beijing (CN); Gang Ci, Beijing (CN); Baolei Guo, Beijing (CN); Xin Wang, Beijing (CN); Lingguo Wang, Beijing (CN); Ying Liu, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/095,892

(22) PCT Filed: Apr. 17, 2018

(86) PCT No.: PCT/CN2018/083313

§ 371 (c)(1),
(2) Date: Oct. 23, 2018

(87) PCT Pub. No.: WO2018/210086

PCT Pub. Date: Nov. 22, 2018

(65) Prior Publication Data

US 2019/0355300 A1 Nov. 21, 2019

(30) Foreign Application Priority Data

May 15, 2017 (CN) ..... 2017 1 0338003

(51) Int. Cl.
*G09G 3/30* (2006.01)
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2310/061* (2013.01); *G09G 2330/021* (2013.01)

(58) Field of Classification Search
CPC ... G09G 3/30; G09G 3/36; G09G 5/00; G06F 3/038
See application file for complete search history.

(56) References Cited

U.S. PATENT DOCUMENTS

2011/0234776 A1* 9/2011 Hanari ..... H04N 13/398 348/56
2014/0313232 A1* 10/2014 Han ..... G09G 3/3696 345/690

(Continued)

*Primary Examiner* — Pegeman Karimi
(74) *Attorney, Agent, or Firm* — Myers Bigel, P.A.

(57) ABSTRACT

A pixel circuit includes a light-emitting device, a reset circuit, a write circuit, a compensation circuit, a light emission control circuit, and a drive circuit. The compensation circuit is configured to selectively transfer an uncompensated reference voltage or a compensated reference voltage to a third node, the compensated reference voltage being determined by the uncompensated reference voltage and a compensation voltage, the compensation voltage being related to a rated value of a power supply voltage. The light emission control circuit is configured to transfer a voltage at the third node to a first node to cause a change in voltage at the second node. The drive circuit is configured to control a magnitude of a drive current flowing through the light-emitting device based on the voltage at the second node and the power supply voltage.

17 Claims, 4 Drawing Sheets

(56) References Cited

U.S. PATENT DOCUMENTS

| | | | | |
|---|---|---|---|---|
| 2015/0287362 | A1* | 10/2015 | Lee | G09G 3/3233 345/77 |
| 2016/0379569 | A1* | 12/2016 | Lee | G09G 3/3233 345/77 |
| 2018/0197469 | A1* | 7/2018 | Lo | G09G 3/3233 |

* cited by examiner

PIXEL CIRCUIT, DRIVING METHOD THEREOF, AND DISPLAY DEVICE

CROSS-REFERENCE TO RELATED APPLICATIONS

The present application is a 35 U.S.C. 371 national stage application of PCT International Application No. PCT/CN2018/083313, filed on Apr. 17, 2018, which claims the benefit of Chinese patent application No. 201710338003.X, filed on May 15, 2017, the contents of which are incorporated herein by reference in their entireties.

TECHNICAL FIELD

The present disclosure relates to the field of display technologies, and in particular, to a pixel circuit, a driving method thereof, and a display device.

BACKGROUND

Conventional organic light-emitting diode displays often display abnormal images during the very first frame period after power-on. This can be caused by an unstable power supply voltage. For example, the power supply voltage may climb from 0 V to 4.6 V after power-on, which will cause abnormal operation of the pixel circuits, thereby affecting the display effect.

SUMMARY

According to an aspect of the present disclosure, a pixel circuit is provided comprising: a light-emitting device; a reset circuit configured to reset a first node and a second node in response to a signal on a first scan line being active; a write circuit configured to, responsive to a signal on a second scan line being active, write a data voltage on a data line to the first node and write a transition voltage to the second node, the transition voltage being related to an instantaneous value of a power supply voltage received at a first power supply terminal; a compensation circuit configured to selectively transfer an uncompensated reference voltage or a compensated reference voltage to a third node, the compensated reference voltage being determined by the uncompensated reference voltage and a compensation voltage, the compensation voltage being related to a rated value of the power supply voltage; a light emission control circuit configured to, responsive to a signal on a light emission control line being active, transfer a voltage at the third node to the first node and provide a path along which a drive current flows from the first power supply terminal to a second power supply terminal through the light-emitting device, the transfer of the voltage at the third node to the first node causing a change in voltage at the second node; and a drive circuit configured to control a magnitude of the drive current based on the voltage at the second node and the power supply voltage.

In some exemplary embodiments, the compensated reference voltage is equal to a sum of the uncompensated reference voltage and the compensation voltage, and the compensation voltage has a magnitude equal to the rated value of the power supply voltage.

In some exemplary embodiments, the compensation circuit comprises: a first diode having a positive electrode connected to a reference voltage terminal to receive the uncompensated reference voltage and a negative electrode connected to a fourth node; a second diode having a positive electrode connected to the fourth node and a negative electrode connected to the third node; and a first capacitor having a first terminal connected to the fourth node and a second terminal connected to a compensation voltage terminal to receive the compensation voltage.

In some exemplary embodiments, the compensation circuit further comprises a second capacitor having a first terminal connected to the third node and a second terminal that is grounded.

In some exemplary embodiments, the reset circuit comprises: a first transistor having a gate connected to the first scan line, a first electrode connected to the first power supply terminal, and a second electrode connected to the first node; and a second transistor having a gate connected to the first scan line, a first electrode connected to a reset voltage terminal, and a second electrode connected to the second node.

In some exemplary embodiments, the drive circuit comprises: a drive transistor having a gate connected to the second node, a source connected to the first power supply terminal, and a drain connected to the light emission control circuit; and a third capacitor connected between the first node and the second node.

In some exemplary embodiments, the transition voltage is equal to the instantaneous value of the power supply voltage plus a threshold voltage of the drive transistor.

In some exemplary embodiments, the write circuit comprises: a third transistor having a gate connected to the second scan line, a first electrode connected to the data line, and a second electrode connected to the first node; and a fourth transistor having a gate connected to the second scan line, a first electrode connected to the drain of the drive transistor, and a second electrode connected to the second node.

In some exemplary embodiments, the light emission control circuit comprises: a fifth transistor having a gate connected to the light emission control line, a first electrode connected to the third node, and a second electrode connected to the first node; and a sixth transistor having a gate connected to the light emission control line, a first electrode connected to the drain of the drive transistor, and a second electrode connected to the light-emitting device.

In some exemplary embodiments, the light-emitting device comprises an organic light-emitting diode having an anode connected to the second electrode of the sixth transistor and a cathode connected to the second power supply terminal.

According to another aspect of the present disclosure, a method of driving the pixel circuit described above is provided, comprising: in a reset phase, resetting by the reset circuit the first node and the second node; in a data write phase, writing by the write circuit the data voltage to the first node and the transition voltage to the second node; and in a light emission phase, selectively transferring by the light emission control circuit the voltage at the third node to the first node, providing by the light emission control circuit the path along which the drive current flows from the first power supply terminal to the second power supply terminal through the light-emitting device, and controlling by the drive circuit the magnitude of the drive current based on the voltage at the second node and the power supply voltage.

According to yet another aspect of the present disclosure, a display device is provided comprising: a plurality of scan lines for transferring scan signals; a plurality of light emission control lines for transferring light emission control signals; a plurality of data lines for transferring data voltages; and a plurality of pixels arranged in an array. The pixel arranged in an n-th row and an m-th column comprises: a light-emitting device; a reset circuit configured to reset a first node and a second node in response to the scan signal on an n-th one of the scan lines being active; a write circuit configured to, responsive to the scan signal on an (n+1)-th one of the scan lines being active, write the data voltage on an m-th one of the data lines to the first node and write a transition voltage to the second node, the transition voltage being related to an instantaneous value of a power supply voltage received at a first power supply terminal; a compensation circuit configured to selectively transfer an uncompensated reference voltage or a compensated reference voltage to a third node, the compensated reference voltage being determined by the uncompensated reference voltage and a compensation voltage, the compensation voltage being related to a rated value of the power supply voltage; a light emission control circuit configured to, responsive to the light emission control signal on an n-th one of the light emission control lines being active, transfer a voltage at the third node to the first node and provide a path along which a drive current flows from the first power supply terminal to a second power supply terminal through the light-emitting device, the transfer of the voltage at the third node to the first node causing a change in voltage at the second node; and a drive circuit configured to control a magnitude of the drive current based on the voltage at the second node and the power supply voltage. N and m are positive integers.

In some exemplary embodiments, the display device further comprises a power supply configured to supply the power supply voltage and the uncompensated reference voltage.

In some exemplary embodiments, the power supply is further configured to generate the compensation voltage based on the power supply voltage.

These and other aspects of the present disclosure will be apparent from and elucidated with reference to the embodiment(s) described hereinafter.

DETAILED DESCRIPTION

It will be understood that, although the terms first, second, third etc. may be used herein to describe various elements, components and/or sections, these elements, components and/or sections should not be limited by these terms. These terms are only used to distinguish one element, component or section from another. Thus, a first element, component or section discussed below could be termed a second element, component or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected to", or "coupled to" another element, it can be directly connected or coupled to the other element, or intervening elements may be present. In contrast, when an element is referred to as being "directly connected to" or "directly coupled to" another element, there are no intervening elements present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

The phrase "a signal being active" as used herein in connection with a circuit or a component of a circuit means that the signal causes the circuit or the component of the circuit to be enabled under the control of the signal. In contrast, the phrase "a signal being inactive" means that the signal causes the circuit or the component of the circuit to be disabled under the control of the signal. For example, for a P-type transistor, the active signal has a low level and the inactive signal has a high level.

For a better understanding of the technical solutions of the present disclosure, embodiments of the present disclosure will be described in detail below with reference to the accompanying drawings.

Figure 1:
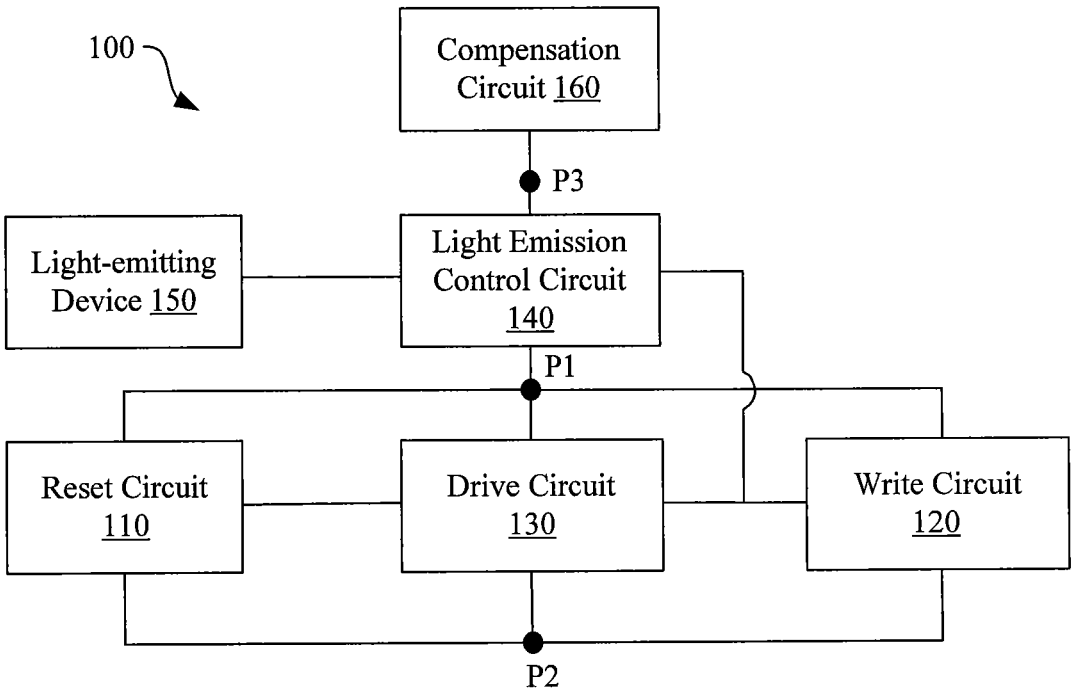
FIG. 1 is a block diagram of a pixel circuit in accordance with an embodiment of the present disclosure.

FIG. 1 is a block diagram of a pixel circuit 100 in accordance with an embodiment of the present disclosure. As shown in FIG. 1, the pixel circuit 100 includes a reset circuit 110, a write circuit 120, a drive circuit 130, a light emission control circuit 140, a light-emitting device 150, and a compensation circuit 160.

The light-emitting device 150 is an electroluminescent device, examples of which include, but are not limited to, organic light-emitting diodes.

The reset circuit 110 is configured to reset a first node P1 and a second node P2 in response to a signal on a first scan line S[n] (not shown in FIG. 1) being active.

The write circuit 120 is configured to, responsive to a signal on a second scan line S[n+1] (not shown in FIG. 1) being active, write a data voltage $V_{data}$ on a data line D[m] (not shown in FIG. 1) to the first node P1 and a transition voltage $V_{temp}$ to the second node P2. As will be described later, the transition voltage $V_{temp}$ is related to an instantaneous value $V_{ELVDD(t)}$ of a power supply voltage $V_{ELVDD}$ received at a first power supply terminal ELVDD (not shown in FIG. 1).

The compensation circuit 160 is configured to selectively transfer an uncompensated reference voltage $V_{ref}$ or a compensated reference voltage $V_{ref0}$ to a third node P3. The compensated reference voltage $V_{ref0}$ is determined by the uncompensated reference voltage $V_{ref}$ and the compensation voltage $V_0$. The compensation voltage $V_0$ is related to a rated value $V_{ELVDD(t2)}$ of the power supply voltage $V_{ELVDD}$.

Specifically, the compensation voltage $V_0$ may have a magnitude equal to the rated value $V_{ELVDD(t2)}$ of the power supply voltage $V_{ELVDD}$.

The light emission control circuit 140 is configured to, responsive to a signal on a light emission control line EM[n] (not shown in FIG. 1) being active, transfer a voltage $V_{p3}$ (=$V_{ref}$ or $V_{ref0}$ at the third node P3 to the first node P1 and provide a path along which a drive current $I_{OLED}$ flows from the first power supply terminal ELVDD through the light-emitting device 150 to a second power supply terminal ELVSS (not shown in FIG. 1). As will be described later, the transfer of the voltage at the third node P3 to the first node P1 causes a change in the voltage $V_{p2}$ at the second node P2.

The drive circuit 130 is configured to control a magnitude of the drive current $I_{OLED}$ based on the voltage $V_{p2}$ at the second node P2 and the power supply voltage $V_{ELVDD}$.

In the very first frame period after power-on (or power-up again after power-down), the instantaneous value $V_{ELVDD(t)}$ of the power supply voltage $V_{ELVDD}$ may climb from $V_{ELVDD(t1)}$ (for example, as low as 0 V) to the rated value $V_{ELVDD(t2)}$ (for example, 4.6 V). This would have caused abnormal operation of the pixel circuit 100 because the drive circuit 130 of the pixel circuit 100 operates based on the voltage $V_{p2}$ at the second node P2 and the power supply voltage $V_{ELVDD}$. Due to the compensation circuit 160 however, the voltage $V_{p2}$ applied to the second node P2 can contain the compensation voltage $V_0$ that is related to the rated value $V_{ELVDD(t2)}$ of the power supply voltage $V_{ELVDD}$. As will be described in detail later, this may eliminate or alleviate the adverse effect of the variation of the instantaneous value $V_{ELVDD(t)}$ (from $V_{ELVDD(t1)}$ to $V_{ELVDD(t2)}$ of the power supply voltage $V_{ELVDD}$ on the drive current $I_{OLED}$. As a result, the splash phenomenon existing in the display image can be avoided.

After the instantaneous value $V_{ELVDD(t)}$ of the power supply voltage $V_{ELVDD}$ climbs to the rated value $V_{ELVDD(t2)}$, the provision of the compensated reference voltage $V_{ref0}$ is no longer necessary. Therefore, the compensation circuit 160 applies only the uncompensated reference voltage $V_{ref}$ to the third node P3. At this time, the voltage $V_{p2}$ does not contain the compensation voltage $V_0$ that is related to the rated value $V_{ELVDD(t2)}$ of the power supply voltage $V_{ELVDD}$.

Figure 2:
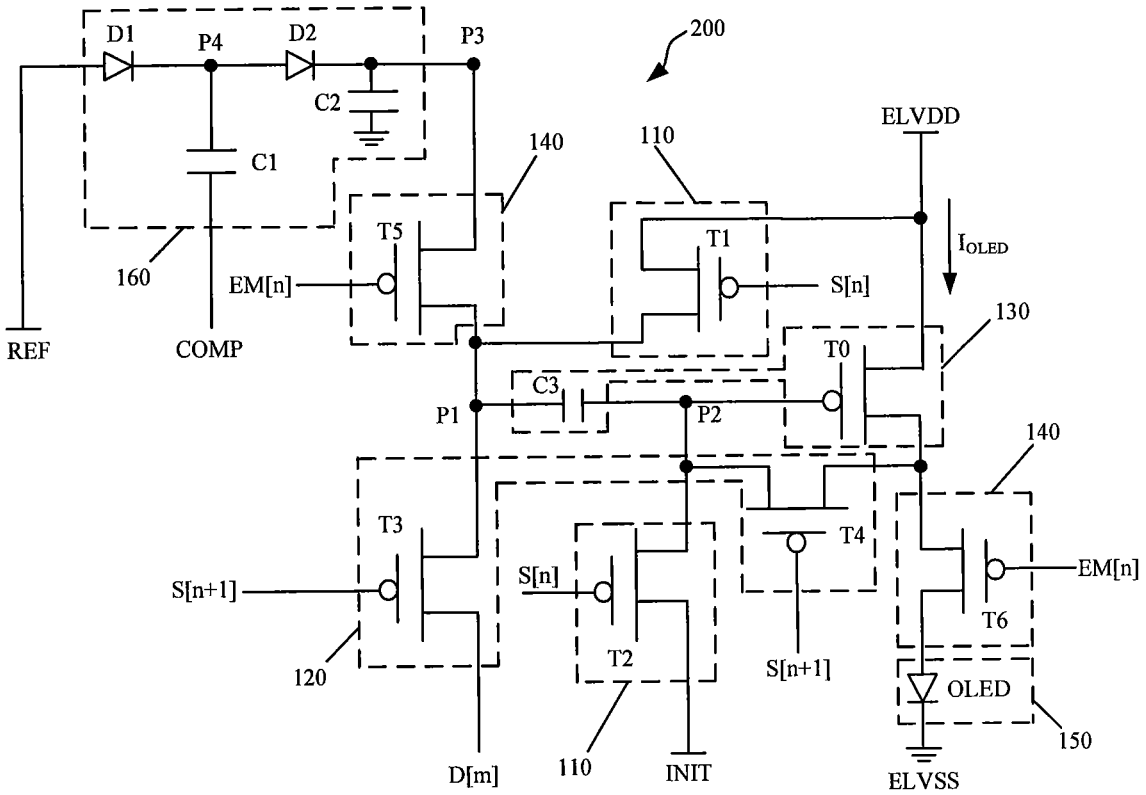
FIG. 2 is a schematic diagram of an example circuit of the pixel circuit shown in FIG. 1.

FIG. 2 is a schematic diagram of an example circuit 200 of the pixel circuit 100 shown in FIG. 1. As shown in FIG. 2, the compensation circuit 160 includes a first diode D1, a second diode D2, and a first capacitor C1. The first diode D1 has a positive electrode connected to a reference voltage terminal REF to receive the uncompensated reference voltage $V_{ref}$ and a negative electrode connected to a fourth node P4. The second diode D2 has a positive electrode connected to the fourth node P4 and a negative electrode connected to the third node P3. The first capacitor C1 has a first terminal connected to the fourth node P4 and a second terminal connected to a compensation voltage terminal COMP to receive the compensation voltage V0. By means of the self-boosting effect of the first capacitor C1, the voltage $V_{p3}$ at the third node P3 can be controlled by controlling the voltage applied to the compensation voltage terminal COMP. For example, when the compensation voltage terminal COMP is applied with a ground voltage (for example, 0 V), $V_{p3}$ is substantially equal to the uncompensated reference voltage $V_{ref}$ (with the turn-on voltages of the diodes D1 and D2 ignored), and when the compensation voltage terminal COMP is applied with the compensation voltage $V_0$ (=$V_{ELVDD(t2)}$), Vp3 will transition from the uncompensated reference voltage $V_{ref}$ to the compensated reference voltage $V_{ref0}=V_{ref}+V_0=V_{ref}+V_{ELVDD(t2)}$. Thus, the rated value $V_{ELVDD(t2)}$ of the power supply voltage $V_{ELVDD}$ can be selectively introduced into the voltage $V_{p2}$ at the second node P2, as will be further described below. In the example shown in FIG. 2, the compensation circuit 160 further optionally includes a second capacitor C2 that has a first terminal connected to the third node P3 and a second terminal grounded. The presence of the second capacitor C2 contributes to the stabilization of the voltage at the third node P3.

Continuing with the example of FIG. 2, the reset circuit 110 includes a first transistor T1 and a second transistor T2. The first transistor T1 has a gate connected to the first scan line S[n], a first electrode connected to the first power supply terminal ELVDD, and a second electrode connected to the first node P1. The second transistor T2 has a gate connected to the first scan line S[n], a first electrode connected to a reset voltage terminal INIT, and a second electrode connected to the second node P2. When the signal on the first scan line S[n] is active, the first node P1 and the second node P2 are respectively reset by the first transistor T1 and the second transistor T2 at respective reset voltages.

The drive circuit 130 includes a drive transistor T0 and a third capacitor C3. The drive transistor T0 has a gate connected to the second node P2, a source connected to the first power supply terminal ELVDD, and a drain connected to the light emission control circuit 140. The third capacitor C3 is connected between the first node P1 and the second node P2. Due to the self-boosting effect of the third capacitor C3, a change in the voltage $V_{p1}$ at the first node P1 may cause a change in the voltage $V_{p2}$ at the second node P2. In response to its gate-source voltage $V_{gs}$ (=$V_{p2}-V_{ELVDD(0)}$, the drive transistor T0 controls the magnitude of the drive current $I_{OLED}$. Specifically, the drive current IOLED can be calculated as $$I_{OLED}=K(V_{gs}-V_{th})^2 \quad (1)$$

where K is typically considered a constant, $V_{gs}$ is the gate-source voltage of the drive transistor T0, and $V_{th}$ is the threshold voltage of the drive transistor T0.

The write circuit 120 includes a third transistor T3 and a fourth transistor T4. The third transistor T3 has a gate connected to the second scan line S[n+1], a first electrode connected to the data line D[m], and a second electrode connected to the first node P1. The fourth transistor T4 has a gate connected to the second scan line S[n+1], a first electrode connected to the drain of the drive transistor T0, and a second electrode connected to the second node P2. When the signal on the second scan line S[n+1] is active, the fourth transistor T4 is turned on such that the drive transistor T0 is in a diode connection state. Thus, the transition voltage $V_{temp}$ is written to the second node P2, which is equal to the instantaneous value $V_{ELVDD(t)}$ of the power supply voltage $V_{ELVDD}$ plus the threshold voltage $V_{th}$ of the drive transistor. At the same time, the data voltage $V_{data}$ on the data line D[m] is written to the first node P1 through the third transistor T3.

The light emission control circuit 140 includes a fifth transistor T5 and a sixth transistor T6. The fifth transistor T5 has a gate connected to the light emission control line EM[n], a first electrode connected to the third node P3, and a second electrode connected to the first node P1. The sixth transistor T6 has a gate connected to the light emission control line EM[n], a first electrode connected to the drain of the drive transistor T0, and a second electrode connected to the light-emitting device 150. When the signal on the light emission control line EM[n] is active, the voltage applied at the third node P3 is transferred to the first node P1 through the fifth transistor T5, causing a change in the voltage $V_{p2}$ at the second node P2. Moreover, the sixth transistor T6 is turned on to form a current path along which the drive current $I_{OLED}$ flows from the first power supply terminal ELVDD through the drive transistor T0 and the light-emitting device 150 to the second power supply terminal ELVSS.

In the example shown in FIG. 2, the light-emitting device 150 is an organic light-emitting diode (OLED) having an anode connected to the second electrode of the sixth transistor T6 and a cathode connected to the second power supply terminal ELVSS. When the drive current $I_{OLED}$ flows through the OLED, the OLED is driven to emit light.

Figure 3:
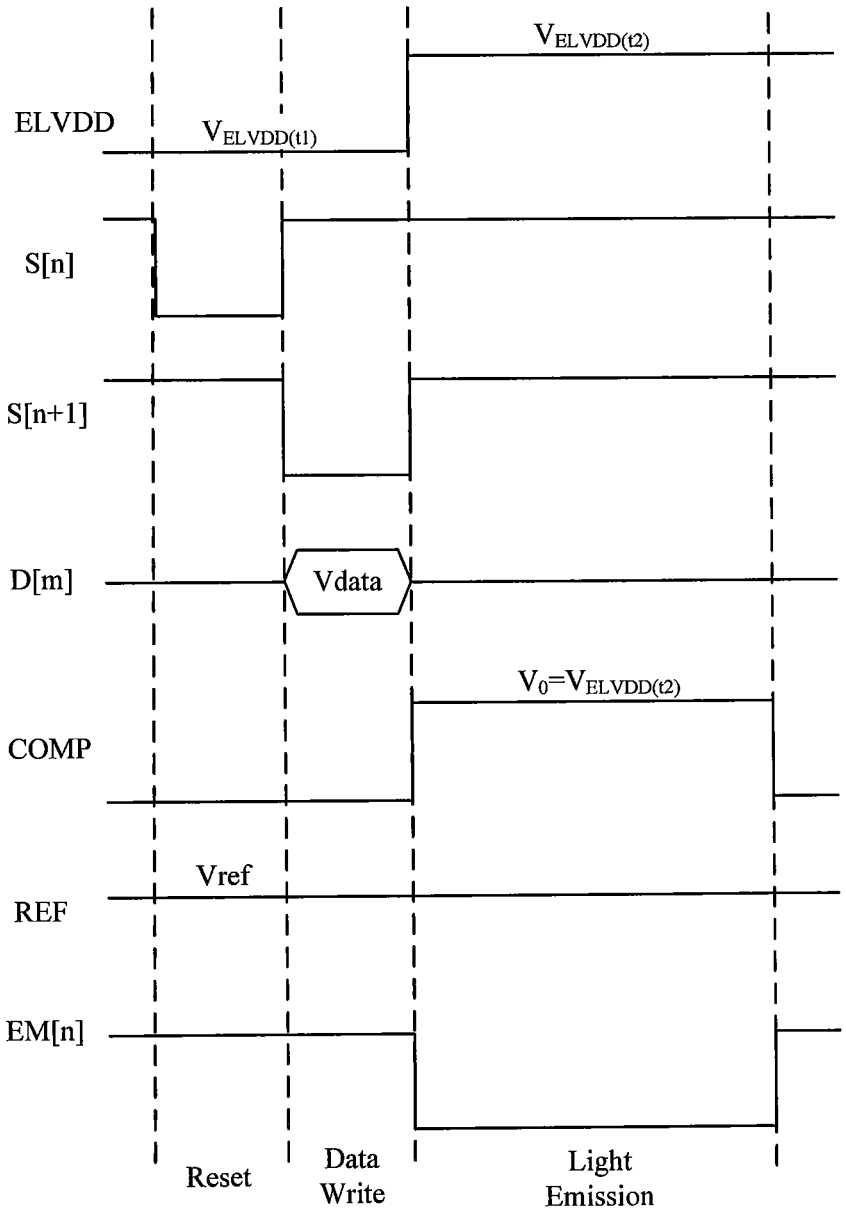
FIG. 3 is an example timing diagram for the example pixel circuit shown in FIG. 2.

FIG. 3 is an example timing diagram for the example pixel circuit 200 shown in FIG. 2. As shown, the pixel circuit 200 undergoes a reset phase, a data write phase, and a light emission phase in one frame period. Without loss of generality, it is assumed that the instantaneous value $V_{ELVDD(t)}$ of the power supply voltage $V_{ELVDD}$ at the first power supply terminal ELVDD is equal to $V_{ELVDD(t1)}$ (for example, 0 V) throughout the data write phase and climbs to the rated value $V_{ELVDD(t2)}$ (for example, 4.6 V) at the beginning of the light emission phase. In practice, the power supply voltage $V_{ELVDD}$ can have a more gradual rising edge and can begin to climb after the light emission phase begins. This does not affect the validity of the concepts of the present disclosure.

The operation of the pixel circuit 200 will be described in detail below by referring to FIGS. 2 and 3.

In the reset phase, the signal on the first scan line S[n] is active, causing the first transistor T1 and the second transistor T2 to be turned on. The first node P1 is reset at $V_{ELVDD(t1)}$ by the turned-on first transistor T1, and the second node P2 is reset by the turned-on second transistor T2 at a reset voltage $V_{init}$ received via the reset voltage terminal INIT. In other words, in the reset phase, $V_{p1}=V_{ELVDD(t1)}$, and $V_{p2}=V_{init}$.

In the data write phase, the signal on the second scan line S[n+1] is active, causing the third transistor T3 and the fourth transistor T4 to be turned on. The data voltage $V_{data}$ on the data line D[m] is written to the first node P1 through the turned-on third transistor T3, and the transition voltage $V_{temp}$ ($=V_{ELVDD(t1)}+V_{th}$) is written by the turned-on fourth transistor T4 to the second node P2. In other words, in the data write phase, $V_{p1}=V_{data}$, and $V_{p2}=V_{ELVDD(t1)}+V_{th}$. Further, the reference voltage $V_{ref}$ applied to the reference voltage terminal REF is transferred to the third node P3 through the first and second diodes D1 and D2 such that the voltage $V_{p3}$ at the third node P3 is substantially equal to the reference voltage $V_{ref}$ (with the turn-on voltages of the diodes D1 and D2 ignored), that is, $V_{p3}=V_{ref}$.

In the light emission phase, the instantaneous value $V_{ELVDD(t)}$ of the power supply voltage $V_{ELVDD}$ reaches the rated value $V_{ELVDD(t2)}$, and the compensation voltage terminal COMP is applied with the compensation voltage $V_0$ that is equal to the rated value $V_{ELVDD(t2)}$. Due to the self-booting effect of the first capacitor C1, the voltage $V_{p3}$ at the third node P3 becomes the compensated reference voltage $V_{ref0}$, which is equal to $V_0+V_{ref}$. At the same time, since the signal on the light emission control line EM[n] is active, the fifth transistor T5 and the sixth transistor T6 are turned on. The voltage $V_{p3}$ at the third node P3 is transferred to the first node P1 through the turned-on fifth transistor T5, that is, the voltage $V_{p1}$ at the first node P1 is changed from $V_{data}$ to $V_0+V_{ref}$. Due to the self-booting effect of the third capacitor C3, the voltage $V_{p2}$ at the second node P2 changes from $V_{ELVDD(t1)}+V_{th}$ to $V_{ELVDD(t1)}+V_{th}+V_0+V_{ref}-V_{data}$. At this time, the gate-source voltage $V_{gs}$ of the drive transistor T0 is equal to $V_{p2}-V_{ELVDD(t2)}=V_{ELVDD(t1)}+V_{th}+V_0+V_{ref0}-V_{data}-V_{ELVDD(t2)}$. Considering that $V_{ELVDD(t1)}=0$ and $V_0=V_{ELVDD(t2)}$, it can be derived from equation (1) that:

$$I_{OLED}=K(V_{gs}-V_{th})^2=K(V_{ELVDD(t1)}+V_{th}+V_0+V_{ref}-V_{data}-V_{ELVDD(t2)}-V_{th})^2=K(V_{ELVDD(t1)}+V_{th}+V_{ELVDD(t2)}+V_{ref}-V_{data}V_{ELVDD(t2)})-V_{th})^2=K(V_{ref}-V_{data})^2$$

It can be seen that the drive current $I_{OLED}$ is independent of the power supply voltage $V_{ELVDD}$ and is therefore unaffected by sudden changes in the power supply voltage $V_{ELVDD}$. This makes it possible to avoid the splash phenomenon resulting from a sudden change in the power supply voltage $V_{ELVDD}$.

In this embodiment, the compensation voltage $V_0$ ($=V_{ELVDD(t2)}$) may be kept applied to the compensation voltage terminal COMP throughout the light emission phase such that the drive current $I_{OLED}$ is not affected by the sudden change in the power supply voltage $V_{ELVDD}$ throughout the light emission phase. Then, since the instantaneous value $V_{ELVDD(t1)}$ of the power supply voltage $V_{ELVDD}$ is stabilized at the rated value $V_{ELVDD}$, the compensation voltage $V_0$ is no longer required. Therefore, the compensation voltage terminal COMP returns to be applied with the ground voltage (for example, 0 V) after the end of the light emission phase. Thus, in the next frame period, the voltage applied to the third node P3 will be the uncompensated reference voltage $V_{ref}$, and the pixel circuit 200 operates normally without compensating for the sudden change in the power supply voltage $V_{ELVDD}$.

Although the first to sixth transistors T1 to T6 are illustrated and described as P-type transistors in the above embodiment, N-type transistors are possible. In the case of N-type transistors, the active signal has a high voltage level and the inactive signal has a low voltage level. The transistors can be, for example, thin film transistors, which are typically fabricated such that their first and second electrodes can be used interchangeably.

Figure 4:
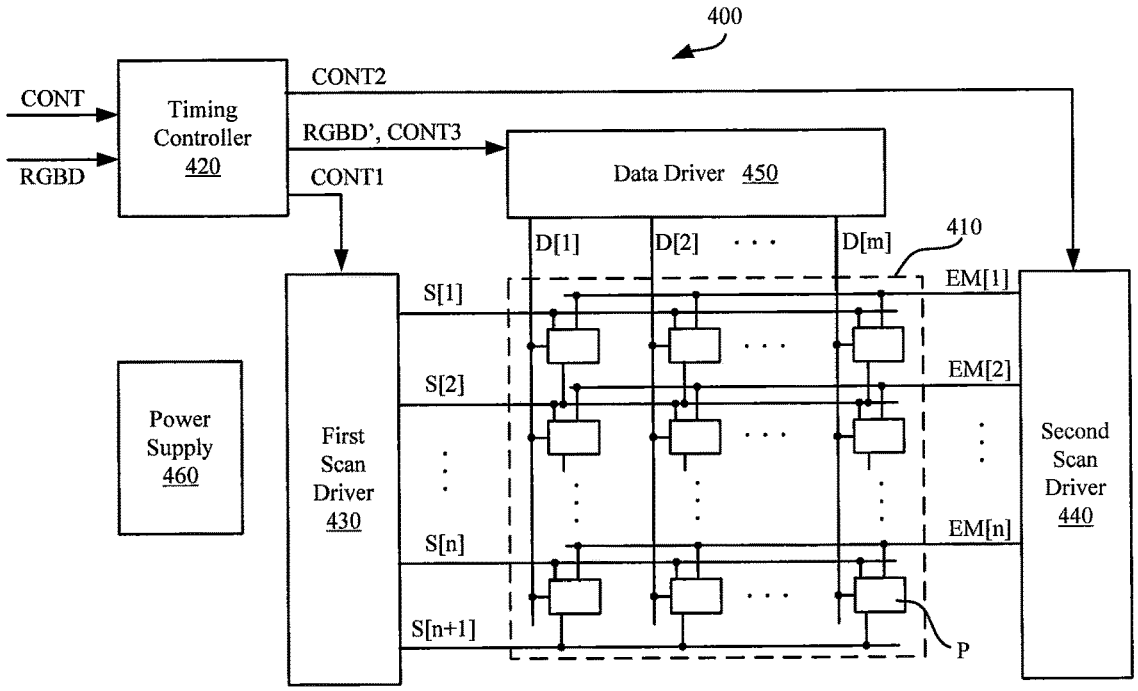
FIG. 4 is a block diagram of a display device in accordance with an embodiment of the present disclosure.

FIG. 4 is a block diagram of a display device 400 in accordance with an embodiment of the present disclosure. Referring to FIG. 4, the display device 400 includes a pixel array 410, a timing controller 420, a first scan driver 430, a second scan driver 440, a data driver 450, and a power supply 460. By way of example and not limitation, display device 400 can be any product or component having a display function, such as a cell phone, a tablet, a television, a monitor, a notebook, a digital photo frame, a navigator, and the like.

The pixel array 410 includes n×m pixels P (n and m being natural numbers) arranged in an array. The pixel array 410 is connected to n+1 first scan lines S1, S2, . . . , Sn and Sn+1 arranged in a row direction to transfer first scan signals, n second scan lines EM1, EM2, . . . , EMn arranged in the row direction to transfer light emission control signals, m data lines D1, D2, . . . , Dm arranged in a column direction to transfer data voltages, and wires (not shown) for supplying the power supply voltage $V_{ELVDD}$ from the power supply 460 to respective ones of the pixels P. Each of the pixels P may take the form of the pixel circuit 100 or 200 as described above.

The timing controller 420 is used to control the first scan driver 430, the second scan driver 440, and the data driver 450. The timing controller 420 receives input image data RGBD and an input control signal CONT from an external device (e.g., a host). The input image data RGBD may include input pixel data for the pixels P. The input control signal CONT may include a main clock signal, a data enable signal, a vertical sync signal, a horizontal sync signal, and the like. The timing controller 420 generates output image data RGBD', a first control signal CONT1, a second control signal CONT2, and a third control signal CONT3 based on the input image data RGBD and the input control signal CONT. The output image data RGBD' is supplied to the data driver 450. The first control signal CONT1, the second control signal CONT2, and the third control signal CONT3 are supplied to the first scan driver 430, the second scan driver 440, and the data driver 450, respectively, and the driving timings of the first scan driver 430, the second scan driver 440, and the data driver 450 is controlled based on the first control signal CONT1, the second control signal CONT2, and the third control signal CONT3, respectively. The first and second control signals CONT1 and CONT2 may include a vertical enable signal, a gate clock signal, and the like. The third control signal CONT3 may include a horizontal enable signal, a data clock signal, a data load signal, and the like. The implementation of the timing controller 420 can be known. The timing controller 420 can be implemented in a number of ways, such as in dedicated hardware, to perform the various functions discussed above. A "processor" is an example of the timing controller 420 that employs one or more microprocessors that can be programmed using software (e.g., microcode) to perform the various functions discussed above. The timing controller 420 can be implemented with or without a processor, and can also be implemented as a combination of dedicated hardware that performs some functions and a processor that performs other functions (e.g., one or more programmed microprocessors and associated circuits).

The first scan driver 430 generates a plurality of scan signals based on the first control signal CONT1. The first scan driver 430 is connected to the scan lines S[1], S[2], . . . , S[n], S[n+1] to apply the generated scan signals to the pixel array 410.

The second scan driver 440 generates a plurality of light emission control signals based on the second control signal CONT2. The second scan driver 440 is connected to the light emission control lines EM[1], EM[2], EM[n] to apply the generated light emission control signals to the pixel array 410.

The data driver 450 receives the third control signal CONT3 and the output image data RGBD' from the timing controller 420, and generates a plurality of data voltages based on the third control signal CONT3 and the output image data RGBD'. The data driver 450 is connected to the data lines D[1], D[2], . . . , D[m] to apply data voltages to the pixel array 410.

The power supply 460 supplies the pixel array 410 with the power supply voltage $V_{ELVDD}$ and the reference voltage $V_{ref}$. In some embodiments, the power supply 460 can also supply power to the timing controller 420, the first scan driver 430, the second scan driver 440, and the data driver 450. Examples of the power supply 460 include, but are not limited to, a DC/DC converter and a low dropout regulator (LDO).

Figure 5:
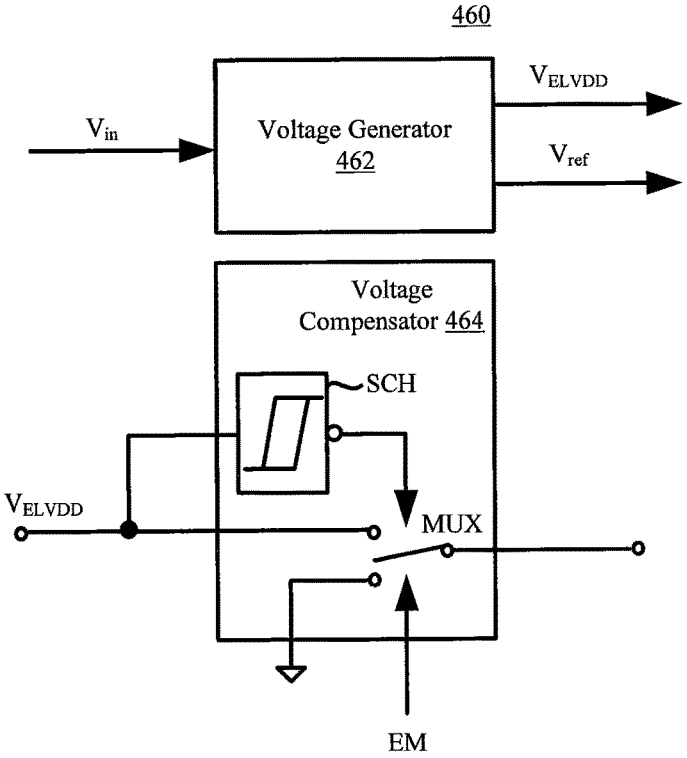
FIG. 5 is a block diagram of a power supply in the display device shown in FIG. 4.

FIG. 5 shows a block diagram of the power supply 460. In this embodiment, in addition to generating the power supply voltage $V_{ELVDD}$ and the reference voltage $V_{ref}$, the power supply 460 is further configured to generate the compensation voltage $V_0$ based on the power supply voltage $V_{ELVDD}$. Referring to FIG. 5, the power supply 460 includes a voltage generator 462 and a voltage compensator 464.

The voltage generator 462, such as a DC/DC converter or a LDO, generates the power supply voltage $V_{ELVDD}$ and the reference voltage $V_{ref}$ from an input voltage $V_{in}$.

The voltage compensator 464 receives the power supply voltage $V_{ELVDD}$ and generates the compensation voltage $V_0$ based on the power supply voltage $V_{ELVDD}$. Specifically, the voltage compensator 464 includes a Schmitt trigger SCH and a multiplexer MUX. The power supply voltage $V_{ELVDD}$ is supplied to the Schmitt trigger SCH as an input signal. During the process of the instantaneous value $V_{ELVDD(t)}$ of the power supply voltage $V_{ELVDD}$ climbing from $V_{ELVDD(t1)}$ to $V_{ELVDD(t2)}$, when $V_{ELVDD}$ is greater than the forward threshold voltage, the output signal of the Schmitt trigger SCH changes from a high level to a low level. In response to this output signal, the multiplexer MUX selectively couples its output terminal to the power supply voltage $V_{ELVDD}$ or a ground voltage. When the output signal of the Schmitt trigger SCH is high, the multiplexer MUX couples its output terminal to the ground voltage; when the output signal of the Schmitt trigger SCH is low, the multiplexer MUX couples its output terminal to the power supply voltage $V_{ELVDD}$, at which time the compensation voltage $V_0$ is output at the output terminal of the multiplexer MUX, which is substantially equal to the rated value $V_{ELVDD(t2)}$ of the power supply voltage $V_{ELVDD}$. The output terminal of the multiplexer MUX may be coupled to the respective compensation voltage terminals COMP (FIG. 2) of the rows of pixels in the pixel array 410 (FIG. 4) via a switching network (not shown), which switching network may supply, under the control of the timing controller 420 (FIG. 4), the compensation voltage $V_0$ from the output terminal of the multiplexer MUX to a desired pixel row in the pixel array 410. The timing controller 420 may be further configured to restore the output terminal of the multiplexer MUX to be coupled to the ground voltage in response to the light emission control signal on the light emission control line EM connected to the desired pixel row changing from active to inactive. The control aspect of the timing controller 420 is beyond the scope of the present disclosure and will not be described in detail herein.

The voltage compensator 464 shown in FIG. 5 is exemplary and the voltage compensator 464 may take other forms. Other embodiments are contemplated. For example, the voltage compensator 464 can be a separate voltage generator that can generate and provide the compensation voltage $V_0$ under the control of the timing controller 420.

It is to be understood that the above embodiments are disclosed for the purpose of illustration only, and that the present disclosure is not limited thereto. Various modifications and improvements may be made to the disclosed embodiments without departing from the scope of the disclosure. Thus, such modifications and improvements are also intended to fall within the scope of the present disclosure.

What is claimed is:

1. A pixel circuit, comprising:

a light-emitting device;

a reset circuit configured to reset a first node and a second node in response to a signal on a first scan line being active;

a write circuit configured to, responsive to a signal on a second scan line being active, write a data voltage on a data line to the first node and write a transition voltage to the second node, wherein the transition voltage is related to an instantaneous value of a power supply voltage received at a first power supply terminal;

a compensation circuit configured to selectively transfer an uncompensated reference voltage or a compensated reference voltage to a third node, the compensated reference voltage being determined by the uncompensated reference voltage and a compensation voltage, the compensation voltage being related to a rated value of the power supply voltage;

a light emission control circuit configured to, responsive to a signal on a light emission control line being active, transfer a voltage at the third node to the first node and provide a path along which a drive current flows from the first power supply terminal to a second power supply terminal through the light-emitting device, wherein the transfer of the voltage at the third node to the first node is configured to cause a change in voltage at the second node; and a drive circuit configured to control a magnitude of the drive current based on the voltage at the second node and the power supply voltage.

2. The pixel circuit of claim 1, wherein the compensated reference voltage is equal to a sum of the uncompensated reference voltage and the compensation voltage, and wherein the compensation voltage has a magnitude equal to the rated value of the power supply voltage.

3. The pixel circuit of claim 2, wherein the compensation circuit comprises:

a first diode comprising a positive electrode connected to a reference voltage terminal configured to receive the uncompensated reference voltage and a negative electrode connected to a fourth node;

a second diode comprising a positive electrode connected to the fourth node and a negative electrode connected to the third node; and a first capacitor comprising a first terminal connected to the fourth node and a second terminal connected to a compensation voltage terminal to receive the compensation voltage.

4. The pixel circuit of claim 3, wherein the compensation circuit further comprises a second capacitor comprising a first terminal connected to the third node and a second terminal that is grounded.

5. The pixel circuit of claim 1, wherein the reset circuit comprises:

a first transistor comprising a gate connected to the first scan line, a first electrode connected to the first power supply terminal, and a second electrode connected to the first node; and a second transistor comprising a gate connected to the first scan line, a first electrode connected to a reset voltage terminal, and a second electrode connected to the second node.

6. The pixel circuit of claim 1, wherein the drive circuit comprises:

a drive transistor comprising a gate connected to the second node, a source connected to the first power supply terminal, and a drain connected to the light emission control circuit; and a third capacitor connected between the first node and the second node.

7. The pixel circuit of claim 6, wherein the transition voltage is equal to the instantaneous value of the power supply voltage plus a threshold voltage of the drive transistor.

8. The pixel circuit of claim 6, wherein the write circuit comprises:

a third transistor comprising a gate connected to the second scan line, a first electrode connected to the data line, and a second electrode connected to the first node; and a fourth transistor comprising a gate connected to the second scan line, a first electrode connected to the drain of the drive transistor, and a second electrode connected to the second node.

9. The pixel circuit of claim 6, wherein the light emission control circuit comprises:

a fifth transistor comprising a gate connected to the light emission control line, a first electrode connected to the third node, and a second electrode connected to the first node; and a sixth transistor comprising a gate connected to the light emission control line, a first electrode connected to the drain of the drive transistor, and a second electrode connected to the light-emitting device.

10. The pixel circuit of claim 9, wherein the light-emitting device comprises an organic light-emitting diode comprising an anode connected to the second electrode of the sixth transistor and a cathode connected to the second power supply terminal.

11. A method of driving a pixel circuit comprising a light-emitting device, a reset circuit, a write circuit, a compensation circuit configured to selectively transfer an uncompensated reference voltage or a compensated reference voltage to a third node, the compensated reference voltage being determined by the uncompensated reference voltage and a compensation voltage, the compensation voltage being related to a rated value of a power supply voltage, a light emission control circuit, and a drive circuit, the method comprising:

in a reset phase, resetting by the reset circuit a first node and a second node;

in a data write phase, writing by the write circuit a data voltage to the first node and a transition voltage to the second node; and in a light emission phase, selectively transferring by the light emission control circuit a voltage at the third node to the first node, providing by the light emission control circuit a path along which a drive current flows from a first power supply terminal to a second power supply terminal through the light-emitting device, and controlling by the drive circuit a magnitude of the drive current based on the voltage at the second node and the power supply voltage.

12. A display device, comprising:

a plurality of scan lines for transferring scan signals;

a plurality of light emission control lines for transferring light emission control signals;

a plurality of data lines for transferring data voltages; and a plurality of pixels arranged in an array, wherein a pixel of the plurality of pixels arranged in an n-th row and an m-th column comprises:

a light-emitting device;

a reset circuit configured to reset a first node and a second node in response to the scan signal on an n-th one of the scan lines being active;

a write circuit configured to, responsive to the scan signal on an (n+1)-th one of the scan lines being active, write the data voltage on an m-th one of the data lines to the first node and write a transition voltage to the second node, the transition voltage being related to an instantaneous value of a power supply voltage received at a first power supply terminal;

a compensation circuit configured to selectively transfer an uncompensated reference voltage or a compensated reference voltage to a third node, the compensated reference voltage being determined by the uncompensated reference voltage and a compensation voltage, the compensation voltage being related to a rated value of the power supply voltage;

a light emission control circuit configured to, responsive to the light emission control signal on an n-th one of the light emission control lines being active, transfer a voltage at the third node to the first node and provide a path along which a drive current flows from the first power supply terminal to a second power supply terminal through the light-emitting device, wherein the transfer of the voltage at the third node to the first node is configured to cause a change in a voltage at the second node; and a drive circuit configured to control a magnitude of the drive current based on the voltage at the second node and the power supply voltage, and wherein n and m are positive integers.

13. The display device of claim 12, wherein the compensated reference voltage is equal to a sum of the uncompensated reference voltage and the compensation voltage, and wherein the compensation voltage has a magnitude equal to the rated value of the power supply voltage.

14. The display device of claim 13, wherein the compensation circuit comprises:

a first diode comprising a positive electrode connected to a reference voltage terminal configured to receive the uncompensated reference voltage and a negative electrode connected to a fourth node;

a second diode comprising a positive electrode connected to the fourth node and a negative electrode connected to the third node; and a first capacitor comprising a first terminal connected to the fourth node and a second terminal connected to a compensation voltage terminal configured to receive the compensation voltage.

15. The display device of claim 14, wherein the compensation circuit further comprises a second capacitor comprising a first terminal connected to the third node and a second terminal that is grounded.

16. The display device of claim 12, further comprising;

a power supply configured to supply the power supply voltage and the uncompensated reference voltage.

17. The display device of claim 16, wherein the power supply is further configured to generate the compensation voltage based on the power supply voltage.

* * * * *